United States Patent [19]

MacArthur

[11] 4,041,575

[45] Aug. 16, 1977

[54] HOOK ASSEMBLAGE

[75] Inventor: J. Roderick MacArthur, Winnetka, Ill.

[73] Assignee: Elder Laboratories, Morton Grove, Ill.

[21] Appl. No.: 709,873

[22] Filed: July 29, 1976

[51] Int. Cl.[2] ..... A44B 21/00

[52] U.S. Cl. ..... 24/73 HH

[58] Field of Search ..... 24/17 AP, 17 A, 73 HH, 24/20 TT, 20 R, 204

[56] References Cited

U.S. PATENT DOCUMENTS

| | | | |
|---|---|---|---|
| 2,063,553 | 12/1936 | Mooney | 24/17 AP |
| 2,286,181 | 6/1942 | Steele | 24/17 AP |
| 2,821,763 | 2/1958 | Dances | 24/86 R |
| 3,182,368 | 5/1965 | Fair | 24/86 B |

*Primary Examiner*—G. V. Larkin

*Attorney, Agent, or Firm*—Dressler, Goldsmith, Clement, Gordon & Shore, Ltd.

[57] ABSTRACT

A hook assemblage is provided and includes a pair of interlocking hooks for removably attaching an object to a fixed surface such as a wall. One hook is attached to the object and the other hook is attached to the wall.

A flap on one hook is receivable in an opening in the other hook to interconnect the hooks and limit relative movement between the hooks in one direction. A second flap on one of the hooks is constructed and arranged to interlock with a portion of the other hook to limit relative movement of the hooks in the opposite direction, and is also movable to a free position in which the hooks can be separated, if desired.

10 Claims, 6 Drawing Figures

HOOK ASSEMBLAGE

BACKGROUND OF THE INVENTION

This invention relates to hooks. More specifically, the present invention pertains to hook assemblages for removably attaching an object to a fixed surface.

Hooks are commonly used for attaching an object, such as a plaque or a painting, to a fixed surface, such as a wall. Conventional hooks include one hook member which is provided with an adhesive securement for attaching the hook to the object, but require an extraneous fastener such as a nail for securing the fastener to a wall. The required use of an extraneous fastener is a disadvantage of this arrangement, particularly because nails are not suitable for use in many types of walls.

Another problem with prior art hooks is that they do not lock the object to the wall, and only the force of gravity maintains the object in position on the wall. As a result, the object is always readily removable from the wall, sometimes undesirably, as when the object is inadvertently bumped. Prior art hooks also have the disadvantage of protruding from behind the object and being undesirably visible.

The present invention, on the other hand, provides a relatively simple and inexpensive hook assemblage which obviates the drawbacks of the aforesaid prior art hooks.

SUMMARY OF THE INVENTION

In accordance with the present invention, there is provided a pair of hook members or hooks for removably attaching an object to a fixed surface. Each hook is provided with securement means so that one hook can be attached to the object and the other hook can be attached to the fixed surface.

At least one of the hooks has a flap which is receivable in an opening defined by the other hook to interconnect the hooks and limit relative movement between the hooks in one direction. At least one of the hooks is also provided with a second flap which is constructed and arranged to interlock with a portion of the other hook to limit relative movement of the hooks in the opposite direction.

To interlock the hooks, the second flap is movable from a free position partially overlapping one face of the other hook, to an interlocking position in which the second flap overlaps the opposite face of the other hook. In the interlocking position, the second flap receives one end of the other hook. Thus, the first and second flaps together lock the two hooks to one another, and the object cannot be removed from the wall until the second flap is moved from the interlocking position back to the free position.

For simplicity, each hook is preferably identical in construction. Thus, each hook has a first slit positioned inwardly of the edge thereof to define an opening and first flap, with each first flap being receivable in the opening in the other hook. In addition, each hook preferably has a second slit extending inwardly from each side edge to define a pair of second flaps on each hook.

The hook assemblage of the present invention locks an object to a wall, yet can be unlocked to remove the object from the wall, if desired. Since the securement means on each hook is preferably a pressure-sensitive adhesive, the hook assemblage can be adhesively secured both to the object and to the wall, with an adhesive-free mechanical attachment between the hook members, thereby obviating the need for extraneous fasteners such as nails. In addition, the hook members can be positioned behind the object where they will be completely hidden from view. The hook assemblage is simple and relatively inexpensive, with both hook members preferably being identical in construction, so that only one type of part needs to be stocked by a user.

DESCRIPTION OF THE PREFERRED EMBODIMENTS

Figure 4:
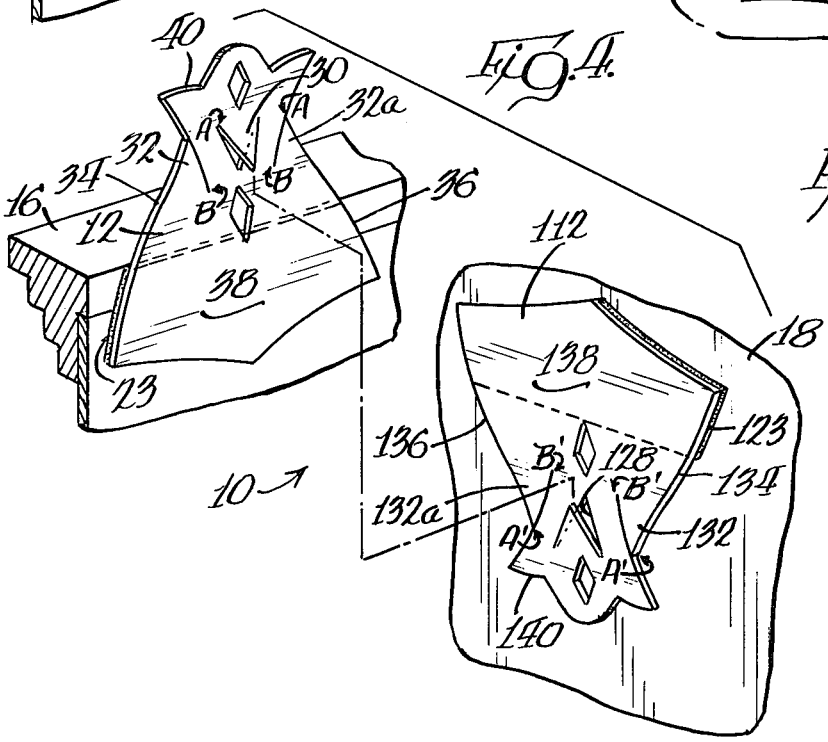
FIG. 4 is a perspective view of the hook assemblage of the present invention with one hook member secured to an object and the other member secured to a surface.
Figure 6:
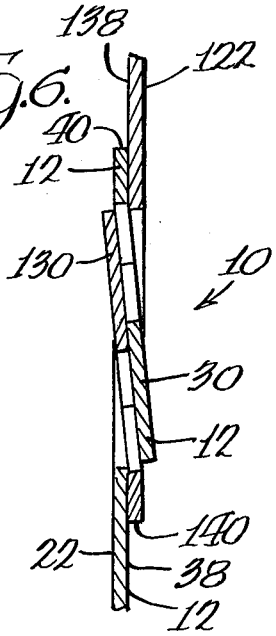
FIG. 6 is a cross-sectional view taken along plane 6—6 in FIG. 5.

Referring first to FIG. 4, there is shown hook assemblage 10 comprising a pair of hook members or hooks 12 and 112 for removably attaching an object, such as picture frame 16, to a fixed surface, such as a wall 18.

The hook members are preferably, but not necessarily, identical in construction for simplicity and to minimize the number of parts to be kept on hand. For convenience, numerals between 12 and 99 are used to refer to hook member 12, and numerals in the one hundred series are used to refer to hook member 112, with the same last two digits in each numeral designating similar elements on both hook members.

Figure 1:
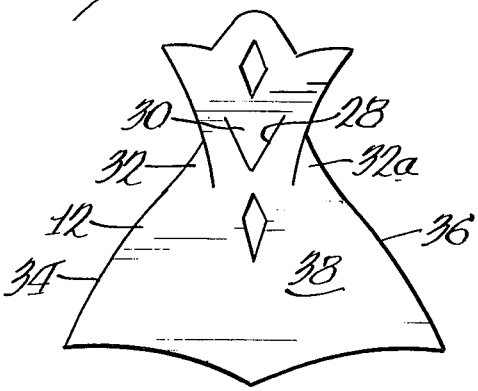
FIG. 1 is a rear elevational view of the hook member of the present invention.
Figure 2:
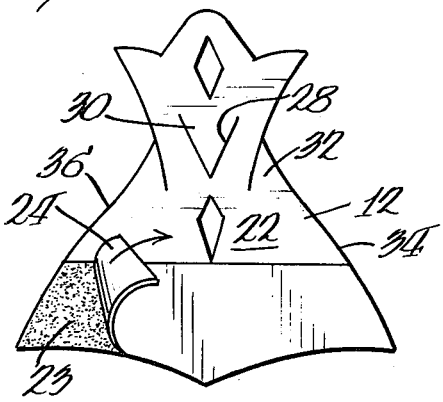
FIG. 2 is a front elevational view of the hook member shown in member 1.

Hooks 12 and 112 are generally flat plates which can be formed of suitable plastic materials, such as mylar, and are desirably flexible. Each hook is provided with means for securing hook 12 to picture frame 16 and hook 112 to wall 18. As shown in FIG. 2, the securement means preferably comprises an adhesive coating 23, 123 on a portion of the front surface 22, 122 of the hooks, with a backing sheet 24, releasably attached to the adhesive coating. A suitable securement means for use with the present invention is double-coated foam (No. 4408, Minnesota Mining and Manufacturing Co.) which is laminated to a sheet of clear mylar having a thickness of 0.010 inch and which is covered by a removable backing sheet.

Figure 3:
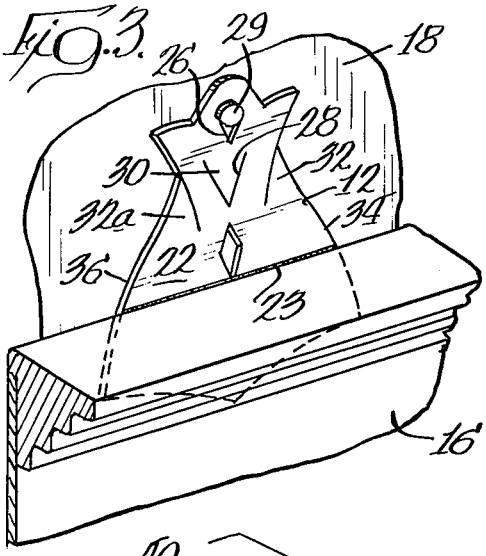
FIG. 3 is a perspective view of the hook member of the present invention secured to an object.

To secure the hooks to the picture frame and wall, respectively, extraneous fastening means may be used instead of adhesive coating 23, 123. At least one aperture 26 extends through each hook for this purpose to accommodate the fastening means, such as nail 29, as shown in FIG. 3. A single hook can thereby be used to secure the object to the wall, with hook 12 being secured to picture frame 16 by means of adhesive coating 23, and to wall 18 by means of nail 29. Consequently, a user has the choice of using a nail instead of the adhesive securement, but is not required to use a nail.

Figure 5:
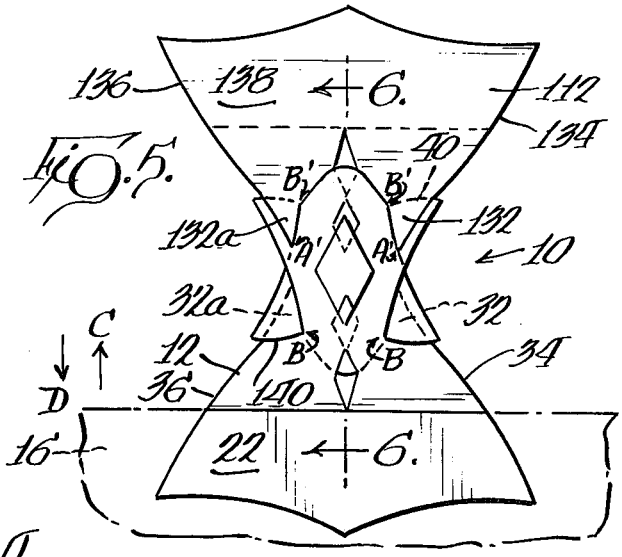
FIG. 5 is an elevational view of the hook assemblage of FIG. 4 in the assembled position.

To interconnect the hooks 12 and 112, an opening 128 is provided in hook 112, and a first flap 30 is provided on hook 12. As shown in FIGS. 4 and 5, flap 30 is receivable in opening 128 to interconnect hooks 12 and 112 and limit relative movement therebetween in one direction. Thus, once interconnected, hook 112 is fixed in position on wall 18 and hook 12 is movable upwardly in the direction of arrow C, but cannot be moved downwardly in the direction of arrow D.

To limit relative movement of the hooks in the opposite direction, second flap means is provided on at least one of the hooks. Although a single flap 32 on one of the hooks will suffice, it is preferred to have a flap 32, 32*a;* 132, 132*a* along each side edge 34, 36; 134, 136 of each hook. Each flap 32, 32*a;* 132, 132*a* is constructed and arranged to interlock with a portion of the other hook to thereby limit movement of hook 12 upwardly in the direction of arrow C relative to hook 112. More specifically, flap 32 is movable between a free position in which back surface 38 of flap 32 is partially juxtaposed to back surface 38 of the other hook, to an interlocking position in which the front surface 22 of flap 32 is juxtaposed to the front surface 22 of the other hook and receives edge 40 of the other hook. Hook 12 can be moved upwardly relative to hook 112 in the free position, but upward movement of hook 12 is limited in the interlocking position. Flaps 32*a,* 132 and 132*a* are likewise movable between the free and the interlocking positions.

Opening 128 and first flap 30 are defined by a first slit positioned inwardly of the edges of each hook. Where hooks 12 and 112 are substantially identical in construction, a first slit defines an opening 28, 128 and first flap 30, 130 on each hook. Flap 30 is receivable in opening 128, and flap 130 is likewise receivable in opening 28 is interconnect the hooks.

Each of the second flaps 32, 32*a,* 132, 132*a,* is defined by a second slit which extends inwardly from one of the side edges 34, 36; 134, 136 of the hooks. Referring to FIGS. 4 and 5, the second slit extends inwardly from a point A along a side edge of one of the hooks to point B. When flaps 30, 130 are received in openings 128, 28, terminal edge 140 of hook 112 is positioned between points A and B on hook 12, and edge 40 of hook 12 is positioned between corresponding points $A^1$ and $B^1$ on hook 112. When second flap 32 is moved to the interlocking position, edges 40 and 140 remain positioned between points $A^1$, $B^1$; A, B to limit relative movement of the hooks.

When flap 30 of hook 12 is received in opening 128 in hook 112, the movement of just one of the flaps 32, 32*a,* 132, 132*a* to the interlocking position will lock the two hooks together, but all of the second flaps can be moved to the interlocking position, if desired. Should it be desired to remove the object such as picture frame 16 from the wall 18, flaps 32, 32*a,* 132, 132*a* can be moved from the interlocking position to the free position. Hook 12 can then be moved upwardly to separate the hooks. If desired, hook 12 can then be repositioned in hook 112 or in another hook to reposition the object on the wall.

While this invention is susceptible of embodiment in many different forms, there is shown in the drawings and has been described herein in detail a specific embodiment of the invention, with the understanding that the present disclosure is to be considered as an exemplification of the principles of the invention and is not intended to limit the invention to the embodiment illustrated.

What is claimed is:

1. A hook assemblage for removably attaching an object to a fixed surface, comprising:

a pair of plates in which one has securement means for securing to said surface and the other has securement means for securing to said object;

said one plate defining an opening;

first flap means on said other plate which is receivable in said opening to interconnect said plates and limit relative movement of said plates in one direction; and second flap means on at least one of said plates which is constructed and arranged to interlock with a portion of the other of said plates to limit relative movement of said plates in the opposite direction.

2. A hook assemblage as described in claim 1 wherein said plates are substantially identical in construction.

3. A hook assemblage as described in claim 1 wherein each plate has a first slit positioned inwardly of the edges thereof, said slit defining said opening in said one plate and said first flap means on said other plate.

4. A hook assemblage as described in claim 3 wherein said slit defines an opening in each of said plates and further defines first flap means in each of said plates.

5. A hook assemblage as described in claim 1 wherein at least one of said plates has a second slit which defines said second flap means.

6. A hook assemblage as described in claim 5 wherein said second slit extends inwardly from the edge of at least one of said plates.

7. A hook assemblage as described in claim 1 wherein each plate has a first slit positioned inwardly of the edges thereof and which defines said opening in said one plate and said first flap means on said other plate, and each plate has a pair of second slits extending inwardly from the edges thereof and which define said second flap means.

8. A hook assemblage as described in claim 1 wherein said securement means comprises a layer of pressure-sensitive adhesive on a portion of one face of each plate.

9. A hook assemblage as described in claim 1 wherein said securement means includes an aperture which is defined by each plate and extends through each plate.

10. A hook assemblage for removably attaching an object to a fixed surface, comprising:

a pair of plates which are substantially identical in construction;

securement means on one plate for securing to said surface, and securement means on the other of said plates for securing to said object;

each plate having a first slit positioned inwardly of the edges thereof to define an opening and first flap means, said first flap means on each plate being receivable in said opening in the other of said plates to interconnect said plates and limit relative movement of said plates in one direction; and each plate having a pair of second slits extending inwardly from the edges thereof to define a pair of second flaps on each plate, with each second flap constructed and arranged to interlock with a portion of the other of said plates to limit relative movement of said plates in the opposite direction.

* * * * *